United States Patent [19]

Uehara et al.

[11] 4,182,581

[45] Jan. 8, 1980

[54] PIPE FOR UNDERDRAINING

[75] Inventors: Yoshio Uehara, Kashiwa; Minoru Inaba; Noriyuki Ishii, both of Chiba; Yoshihisa Kusumi, Urawa, all of Japan

[73] Assignee: Mitsui Petrochemical Industries, Ltd., Tokyo, Japan

[21] Appl. No.: 887,608

[22] Filed: Mar. 17, 1978

[51] Int. Cl.[2] ..... E02B 13/00; F16L 11/11

[52] U.S. Cl. ..... 405/43; 405/49; 138/173

[58] Field of Search ..... 61/11, 10, 12, 13; 138/172, 173; 405/43, 48, 49

[56] References Cited

U.S. PATENT DOCUMENTS

| | | | |
|---|---|---|---|
| 2,433,300 | 12/1947 | Shafer | 61/11 |
| 3,566,607 | 3/1971 | Sixt | 61/11 |
| 3,753,352 | 8/1973 | McNally | 61/10 |
| 3,830,373 | 8/1974 | Sixt | 61/11 |

FOREIGN PATENT DOCUMENTS

| | | | |
|---|---|---|---|
| 2343866 | 3/1975 | Fed. Rep. of Germany | 61/11 |
| 1458179 | 10/1966 | France | 61/11 |

*Primary Examiner*—Mervin Stein
*Assistant Examiner*—Alexander Grosz
*Attorney, Agent, or Firm*—Cooper, Dunham, Clark, Griffin & Moran

[57] ABSTRACT

A pipe for underdrainage comprises (1) a liquid-collecting pipe; (2) a plurality of discontinuous protrusions on the outer surface of the liquid-collecting pipe; (3) a filter layer capable of passing liquid while substantially excluding solids, the filter layer being disposed around the liquid-collecting pipe and contacting the top portions of the protrusions; and (4) a liquid-conducting way composed of a space communicating both in the longitudinal direction and in the peripheral direction of the liquid collecting pipe and defined by the protrusions, the outer surface of the liquid-collecting pipe and the inner surface of the filter layer.

8 Claims, 15 Drawing Figures

PIPE FOR UNDERDRAINING

BACKGROUND OF THE INVENTION

1. Field of the Invention

This invention relates to a pipe for underdraining.

2. Description of the Prior Art

Since prior art pipes for underdraining have through holes on the pipe wall and nothing else, various filter materials such as rubbles, gravels, chaffs and the like are disposed around the pipe for the purpose of preventing choking of the through-holes and enhancing the water-collecting capacity. However, it is very difficult to prevent completely clogging and further the working is complicated and requires many hands.

SUMMARY OF THE INVENTION

An object of the present invention is to provide a pipe for underdraining free from the above mentioned drawbacks.

Another object of the present invention is to provide a pipe for underdrainage having a filter member substantially free from clogging.

A further object of the present invention is to provide a pipe for underdrainage which can be easily arranged.

Still another object of the present invention is to provide a pipe for underdrainage which enables to construct an underdrainage system without requiring many hands.

According to the present invention, there is provided a pipe for underdrainage which comprises:

(1) a liquid-collecting pipe;

(2) a plurality of discontinuous protrusions on the outer surface of the liquid-collecting pipe;

(3) a filter layer which permits the passage of liquids while substantially exluding solids the filter layer being disposed around the liquid-collecting pipe and contacting the top portions of the protrusions; and (4) a liquid-conducting way composed of a space communicating both in the longitudinal direction and in the peripheral direction of the liquid collecting pipe and defined by the protrusions, the outer surface of the liquid-collecting pipe and the inner surface of the filter layer.

BRIEF DESCRIPTION OF THE DRAWING

FIGS. 10A and 10B are side views of joint members, and FIGS. 10C and 10D are cross sectional views thereof;

DESCRIPTION OF THE PREFERRED EMBODIMENTS

In the following the present invention is explained referring to the attached drawing.

Figure 1:
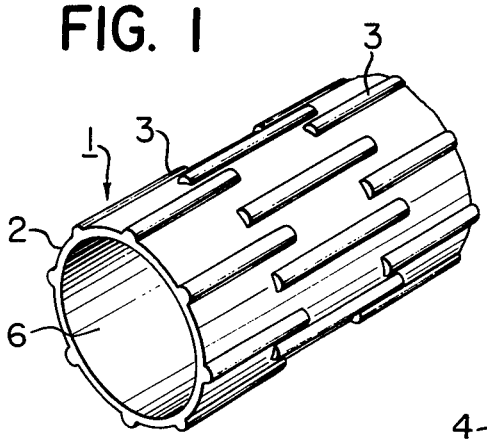
FIG. 1 is an oblique view of an embodiment of the present invention.
Figure 2:
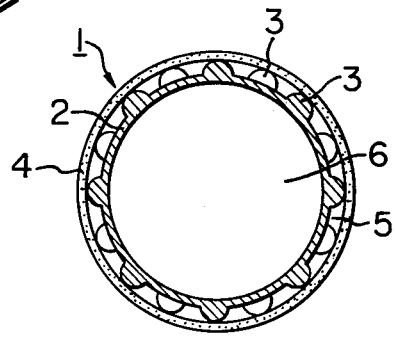
FIG. 2 is a cross-sectional view of the embodiment in FIG. 1.

A pipe for underdrainage 1 is composed of a liquid-collecting pipe 2, discontinuous protrusion portions 3, 3—and a filter layer 4 as shown in FIG. 1 and FIG. 2 (the filter layer is not shown in FIG. 1). A liquid-conducting way 5 is defined by the outer surface of liquid-collecting pipe and the filter layer 4.

In FIG. 1, protrusions 3, 3—are regularly disposed zigzag and partly overlap in the longitudinal direction. However, the protrusions may be disposed irregularly since the protrusions are used for forming a certain space between filter layer 4 and the outer surface of liquid-collecting pipe 2.

The shape of protrusion 3 in FIG. 1 and FIG. 2 is a semicircular rod, but the shape may be a circular rod, a semicircular hollow rod or a rod having any other optional cross section. The protrusions 3 may be integrally formed with liquid-collecting pipe 2 or may be removably formed on liquid-collecting pipe 2.

In FIG. 1 and FIG. 2, the cross sectional shape of liquid-collecting pipe 2 is circular, but may be elliptical, triangular, or rectangular. And the protrusions 3 may be distributed all over the surface of the liquid-collecting pipe or disposed only at some particular areas of said surface. Such design factors may be optionally selected depending upon the purpose of constructing the underdrainage system. The reference numeral 6 denotes a liquid way where a liquid such as water collected in the liquid-collecting pipe flows, in FIGS. 1–11.

Figure 3:
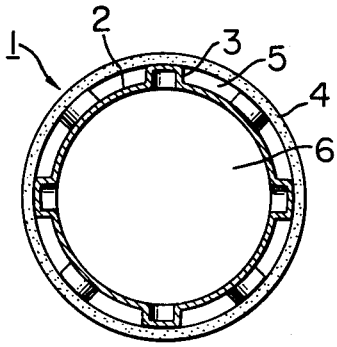
FIG. 3 is a cross-sectional view of another embodiment of the present invention.

It is possible to shape the protrusions 3 as illustrated in FIG. 3 in such a way that the wall thickness is uniform. When the protrusions are so shaped, a high strength of the pipe is obtained with a small amount of plastics. The shape of the protrusions may be any form as far as a space can be formed between the outer surface of liquid-collecting pipe 2 and filter layer 4, and may be optionally selected for producing desirable results.

Figure 4:
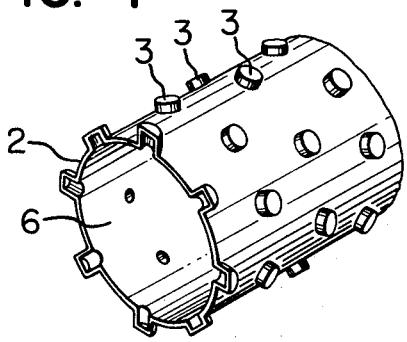
FIG. 4 is an oblique view of a further embodiment of the present invention.

In FIG. 4, button-like protrusions 3, 3—are regularly disposed zigzag on the outer surface of liquid-collecting pipe 2, but may be irregularly disposed and the shape of protrusions may be frustoconical.

Figure 5:
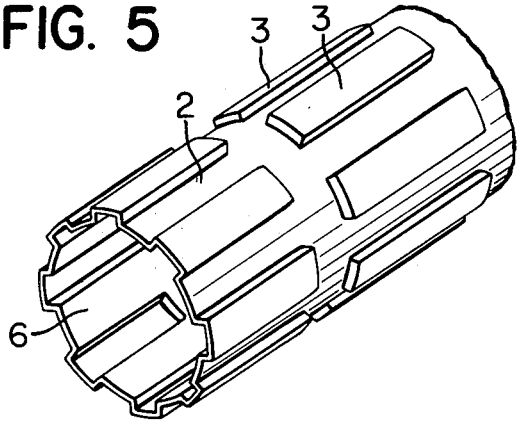
FIG. 5 is an oblique view of a still another embodiment of the present invention.
Figure 6:
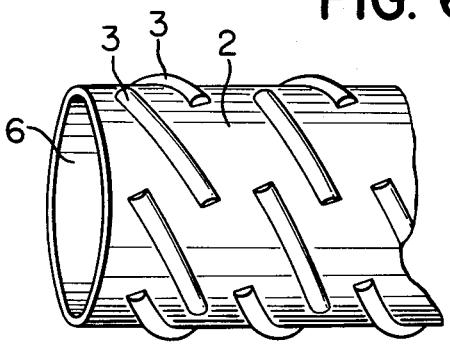
FIG. 6 is an oblique view of a still further embodiment of the present invention.

In FIG. 5, rectangular protrusions 3, 3—are disposed zigzag, and the space volume between the outer surface of the liquid-collecting pipe 2 and a filter layer 4 (not shown) is not reduced by soil pressure because the size of the protruded portion is very large.

Figure 7:
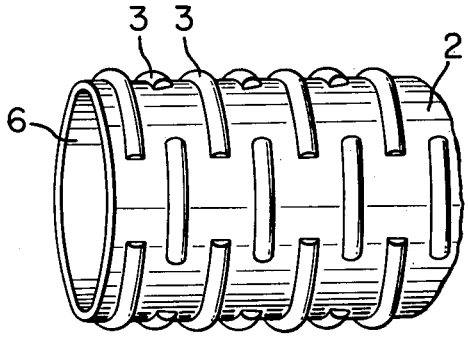
FIG. 7 is an oblique view of a still another embodiment of the present invention.

When the protrusions are in a form of strip, they may be disposed on the surface of liquid-collecting pipe 2 longitudinally (FIG. 1 and FIG. 5), spirally and obliquely (FIG. 6) or peripherally (FIG. 7). This disposition may be selected optionally depending upon the purpose of construction and the tensile and the compression strengths.

Collection of liquid into a liquid-collecting pipe 2 can be accelerated by providing small through-holes at the pipe wall of a liquid-collecting pipe 2 which can communicate a liquid-conducting way with a liquid way 6.

Figure 8:
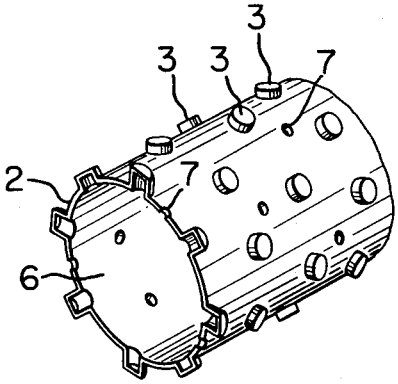
FIG. 8 and FIG. 9 are oblique views of still further embodiments of the present invention.
Figure 9:
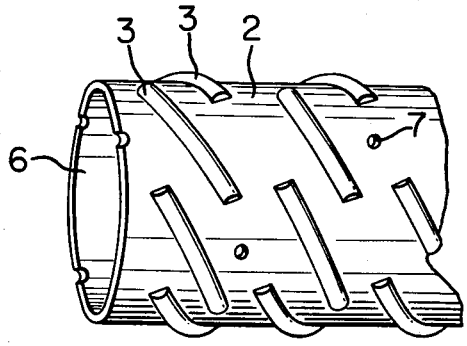

FIG. 8 and FIG. 9 show small through-holes 7, 7— provided on the pipe wall of a liquid-collecting pipe 2. The water passing through the filter layer (not shown) flows in the liquid-conducting way and flows into the liquid-collecting pipe 2 through the small through-holes 7, 7—, and the small through-holes are provided among protrusions. However, small through-holes may be provided at the protrusions. Further, small through-holes may be provided on the liquid-collecting pipes in the other embodiments in the drawing.

Conventional underdrainage pipes having such small through-holes on the pipe wall suffer from clogging of the through-holes while the underdrainage pipes according to the present invention are free from such drawback as clogging caused by sand and soil because a liquid-conducting way 5 formed by a filter layer and protrusions is present.

Instead of the small through-holes 7, water can be led into the liquid-collecting pipe 2 at the joint portion, and if desired, small through-holes may also be provided.

Figure 10A:
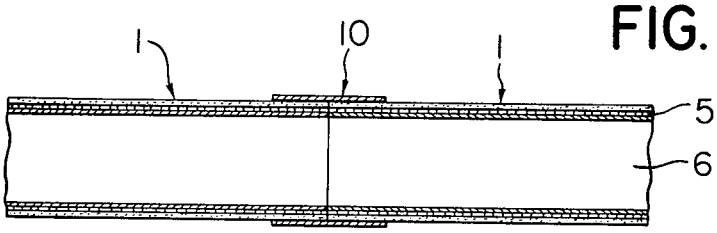
FIGS. 10A, 10B, 10C and 10D shown connecting portions of pipes for underdraining of the present invention.
Figure 10B:
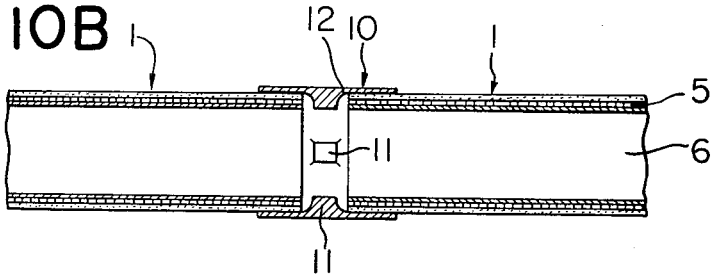
Figure 10C:
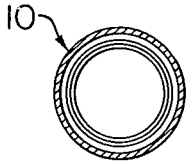
Figure 10D:
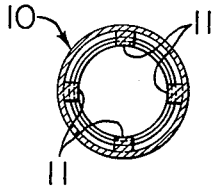
Figure 11:
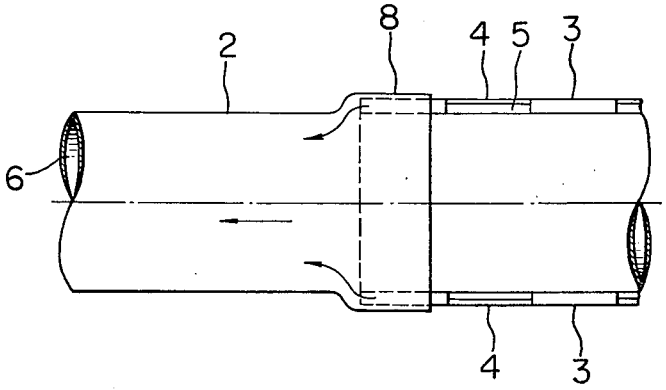
FIG. 11 is a side view, partially in section, of liquid collecting pipes connected with each other.

According to the present invention, the underdrainage pipes may be long or short, and when they are short, if desired, they may be connected one another as shown in FIG. 10 and FIG. 11.

FIG. 10A shows butt joint of underdrainage pipes 1 by using a joint 10. In this case, liquid-conducting ways 5 of both pipes are directly connected and therefore, small through-holes 7 (e.g. in FIG. 8) are necessary to introduce water into a liquid way 6 in the liquid-collecting pipe 2. FIG. 10C is a cross section of the joint portion of FIG. 10A. FIG. 10B shows an embodiment of introducing water into the liquid-collecting pipe 5 through the end portions of underdrainage pipes. A concentric pipe type joint 10 has discontinuous protrusions 11 inside, and in this case, water can be led into a liquid way 6 from a liquid-conducting way 5, but it is preferable also to provide the small through-holes.

FIG. 10D is a cross section of the joint portion of FIG. 10B.

When the joint 10 has a concentric continuous protrusion inside (not shown), small through-holes are necessary to communicate the liquid-conducting way with the liquid way, but even in such case, the small through-holes are dispensable if the cross sectional shape in the longitudinal direction has a curved line 12 in FIG. 10B (assuming that the protrusion 11 is continuous even though the protrusions 11 in FIG. 10B are discontinuous ones) and thereby the communication between the liquid-conducting way and the liquid way is not disturbed by the joint.

Instead of the joint members 10, 10 in FIG. 10, there may be used a pipe type joint having both reduced ends or both enlarged ends for connection.

It is also possible to connect the underdrainage pipes without employing any particular joint member. For example, in FIG. 11, a liquid-collecting pipe 2 has an enlarged end portion 8, and the left end of an underdrainage pipe at the right hand is fitted into the enlarged end portion 8 and thereby a liquid-conducting way 5 is communicated with a liquid way in the liquid-collecting pipe 2 at the left hand. Thus, a liquid such as water passes through a filter layer 4 and flows in a liquid-conducting 5 defined by the filter layer 4, the outer surface of the liquid collecting pipe and protrusions 3 and then flows into a liquid way 6 at the enlarged portion 8.

A further example of connecting the underdrainage pipes of the present invention is that one underdrainage pipe having no filter layer at the end portion is fitted into a cylindrical filter layer extended from one end of the other underdrainage pipe.

As mentioned above, the liquid-conducting way is communicated with the liquid way inside of the liquid-collecting pipe at the end portion and/or through small through-holes at the pipe wall of the liquid-collecting pipe, and the liquid-collecting efficiency is enhanced.

Figure 12:
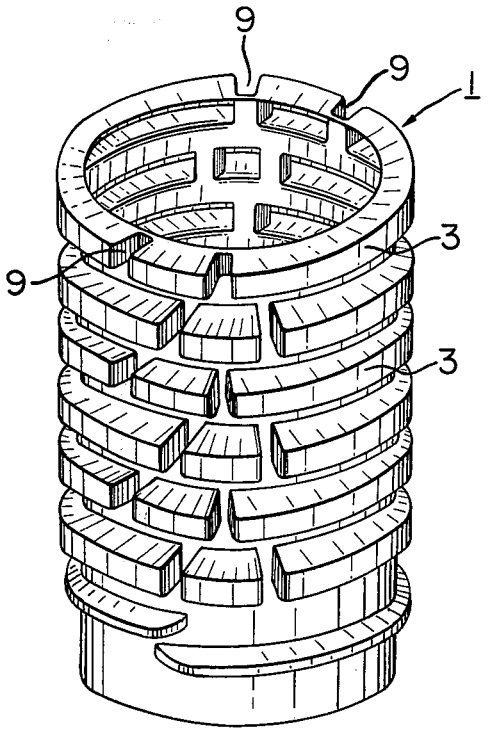
FIG. 12 is an oblique view of a further embodiment of the present invention.

FIG. 12 shows another embodiment of the present invention which has protrusions 3 disposed in a peripheral direction and having recesses 9, and the recesses 9 are not uniformly distributed along the periphery, but are present at two particular portions. This type of recess distribution is convenient for manufacturing the pipe by plastic molding, i.e. for removing separated molds after molding. In other words, a liquid-collecting pipe is firstly shaped and then put between metal molds having recesses and protrusions on the inside surface while the shaped pipe is still hot and thereby a recess and protrusion pattern is formed on the surface of the pipe. In the above procedure, a two-separable metal mold is usually used and it is preferable to position the recesses at two portions to which directions from the axis of the pipe the two metal molds are separated for easy removal. In a similar way, if a three-separable or more separable mold is used, the recesses are produced at the portions on the periphery to which directions from the axis of the pipe the separated molds are removed.

The filter layer 4 which captures solid particles such as soil and sands flowing together with underground water and surface water and allows substantially liquid only to pass through, used in the present invention may be a synthetic resin net, a net made of synthetic or natural fibers, a woven cloth, non-woven cloth, a sheet-like material having through-holes produced by a mechanical means, a foamed sheet, or a foamed sheet having small through-holes produced by rupturing foams during the foam shaping, or combination thereof, diameter of the small hole is usually 0.1–5 mm., preferred with 1–2 mm. when produced by rupturing foams of a foamed sheet.

The filter layer 4 may be disposed around the liquid-collecting pipe having protrusions by simply covering the liquid-collecting pipe or fixed to the top portions of the protrusions. Where both the protrusions and the filter layer are composed of synthetic resins, they can be thermally adhered with each other so that the production, construction and maintenance are easy and sure.

As mentioned above, the liquid-collecting way 5 of the underdrainage pipe according to the present invention communicates longitudinally as well as peripherally on the outer surface of the liquid-collecting pipe 2 so that the liquid can freely flow in various directions and the flow state is very good. The protrusions 3 function as ribs for the liquid-collecting pipe so that mechanical strength of the liquid-collecting pipe 2 is enhanced. Where the liquid-collecting pipe 2 and the filter layer 4 are made of synthetic resins, they are light, durable and corrosion-resistant. In particular, where they are made of polyolefin, clogging is negligible.

The underdrainage pipes according to the present invention can be easily used to construct a sure underdrainage system without using conventional filter materials such as chaffs, rubbles, and gravels, but if desired, such conventional filter materials may be used together with the underdrainage pipes of the present invention.

The underdrainage pipe of the present invention may be buried in the ground for facilitating drainage at agricultural fields, lands for housing, damp grounds, playing fields, and tennis courts. Playing fields and tennis courts can be used in a short time after rain.

What we claim is:

1. A pipe for underdrainage which comprises:

(1) a liquid collecting pipe;

(2) a plurality of discontinuous protrusions on the outer surface of the liquid collecting pipe;

(3) a plurality of through-holes on the outer surface of the liquid collecting pipe and between the discontinuous protrusions;

(4) a filter layer which permits the passage of liquids while substantially excluding solids, the filter layer being disposed around the liquid collecting pipe and contacting the top portions of the protrusions; and (5) a liquid conducting way composed of a space communicating both in the longitudinal direction and in the peripheral direction of the liquid collecting pipe and defined by the protrusions, the outer surface of the liquid collecting pipe and the inner surface of the filter layer.

2. A pipe for underdrainage according to claim 1 in which the liquid collecting pipe has small through-holes.

3. A pipe for underdrainage according to claim 1 in which the protrusions are button-like.

4. A pipe for underdrainage according to claim 1 in which the protrusions discontinuously extend in the longitudinal direction as to the liquid-collecting pipe.

5. A pipe for underdrainage according to claim 1 in which the protrusion discontinuously extend in the peripheral direction as to the liquid-collecting pipe.

6. A pipe for underdrainage according to claim 1 in which the protrusions discontinuously extend spirally.

7. A pipe for underdrainage according to claim 1 in which the protrusions are hollow.

8. A pipe for underdrainage according to claim 1 in which the protrusions are hollow and discontinuously extend in the peripheral direction as to the liquid collecting pipe and the filter layer is composed of a foamed sheet having small through-holes.

* * * * *